US009949613B2

(12) United States Patent
Blanchard et al.

(10) Patent No.: US 9,949,613 B2
(45) Date of Patent: Apr. 24, 2018

(54) DISHWASHER WITH SLIDABLE TINE ASSEMBLY

(75) Inventors: Walter T. Blanchard, Saint Joseph, MI (US); David H. Chen, Saint Joseph, MI (US); Daniel Fry, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1523 days.

(21) Appl. No.: 13/115,339

(22) Filed: May 25, 2011

(65) Prior Publication Data

US 2012/0298155 A1 Nov. 29, 2012

(51) Int. Cl.
*A47L 15/50* (2006.01)

(52) U.S. Cl.
CPC ..... *A47L 15/50* (2013.01); *A47L 15/505* (2013.01)

(58) Field of Classification Search
CPC ..... A47L 15/50; A47L 15/501; A47L 15/502; A47L 15/503; A47L 15/504; A47L 15/505
USPC ..... 211/41.8; 312/228, 228.1
See application file for complete search history.

(56) References Cited

U.S. PATENT DOCUMENTS

| | | | |
|---|---|---|---|
| 3,433,363 | A | 3/1969 | Clearman et al. |
| 3,451,556 | A | 6/1969 | MacOicz |
| 3,752,322 | A | 8/1973 | Fiocca et al. |
| 4,046,261 | A | 9/1977 | Yake |
| 4,606,464 | A | 8/1986 | Jordan et al. |
| 4,917,248 | A | 4/1990 | Friskney |
| 5,462,348 | A | 10/1995 | Ellingson et al. |
| 5,480,035 | A | 1/1996 | Smith |
| 5,649,630 | A | 7/1997 | Remmler |
| 7,231,929 | B2 | 6/2007 | Landsiedel et al. |
| 7,682,465 | B2 | 3/2010 | Anderson et al. |
| 2005/0109378 | A1 | 5/2005 | Landsiedel et al. |
| 2006/0108298 | A1 | 5/2006 | Kim |
| 2006/0254994 | A1 | 11/2006 | Lim |
| 2007/0247039 | A1 | 10/2007 | Anderson et al. |
| 2008/0083678 | A1 | 4/2008 | Graute |
| 2009/0090681 | A1 | 4/2009 | Graute |
| 2009/0120883 | A1 | 5/2009 | Jadhav et al. |
| 2010/0043848 | A1 | 2/2010 | Moser et al. |
| 2010/0314977 | A1* | 12/2010 | Mallory et al. ..... 312/228.1 |
| 2012/0292269 | A1* | 11/2012 | Klump et al. ..... 211/41.8 |

FOREIGN PATENT DOCUMENTS

| | | | |
|---|---|---|---|
| DE | 19947152 | B4 | 10/2009 |
| JP | 4314415 | A | 11/1992 |
| JP | 10033453 | A | 2/1998 |
| JP | 2000139809 | A | 5/2000 |
| JP | 2000237025 | A | 9/2000 |
| JP | 2005000226 | A | 1/2005 |
| JP | 2007244404 | A | 9/2007 |
| JP | 2007319486 | A | 12/2007 |
| KR | 20070008807 | A | 1/2007 |
| KR | 20070062653 | A | 6/2007 |
| KR | 20070062656 | A | 6/2007 |

(Continued)

*Primary Examiner* — Spencer E Bell
(74) *Attorney, Agent, or Firm* — McGarry Bair PC

(57) ABSTRACT

A dishwasher for cleaning utensils comprising a tub, a spray system, and a rack having a wireframe body, a set of fixed tines disposed on the bottom, and a set of slidably adjustable tines arranged in pairs and adjustable relative to the fixed set of paired tines.

11 Claims, 6 Drawing Sheets

(56) References Cited

FOREIGN PATENT DOCUMENTS

| | | | |
|---|---|---|---|
| KR | 20070062657 | A | 6/2007 |
| KR | 100780357 | B1 | 11/2007 |
| KR | 20080012597 | A | 2/2008 |
| KR | 20100032204 | A | 3/2010 |
| WO | 2008137849 | A1 | 11/2008 |
| WO | 2010094420 | A1 | 8/2010 |

* cited by examiner

DISHWASHER WITH SLIDABLE TINE ASSEMBLY

BACKGROUND OF THE INVENTION

Contemporary dishwashers include one or more racks to receive and hold utensils that may be treated in the treating chamber. The utensils in the rack may be sprayed with liquid supplied from one or more spray arm assemblies to wash off food soil from the surface of the utensils according to a wash cycle.

For some dishwashers, oversized utensils, such as a pie pan or a deep bowl, may not be able to stand in the rack, and may need to be laid down for washing. This configuration may limit the number of utensils that may be loaded in the rack for washing, and further mask enhanced chemical action by liquid provided to the utensils.

BRIEF DESCRIPTION OF THE INVENTION

A dishwasher having a tub at least partially defining a treating chamber, a spray system for spraying liquid in the treating chamber, and a rack located within the treating chamber and having a wireframe body having a bottom, front, back, and sides; a set of fixed tines disposed on the bottom and spanning from front to back in rows along a portion of the rack; and a set of slidably adjustable tines arranged in pairs and adjustable relative to the fixed set of paired tines, with the paired adjustable tines sliding in a parallel path to the fixed set of paired tines.

DESCRIPTION OF EMBODIMENTS OF THE INVENTION

The invention is generally directed toward a dishwasher with a rack having a slidably adjustable tine assembly that can receive utensils with various shapes and dimensions in a rack in a dishwasher. The particular approach of the invention is to provide the slidably adjustable tine assembly with a carriage that may slide relative to fixed tines in the dish rack to adjust the relative spacing and, thereby, accommodate different sized utensils, especially oversized bowls or pans that have a depth great enough to prevent them from fitting between the fixed tines, thereby, requiring that they be laid down instead of stood up, which takes up much more space. For purposes of this description, the term "utensil(s)" is intended to be generic to any item, single or plural, that may be treated in the dishwasher 10, including, without limitation; dishes, plates, pots, bowls, pans, glassware, and silverware.

Figure 1:
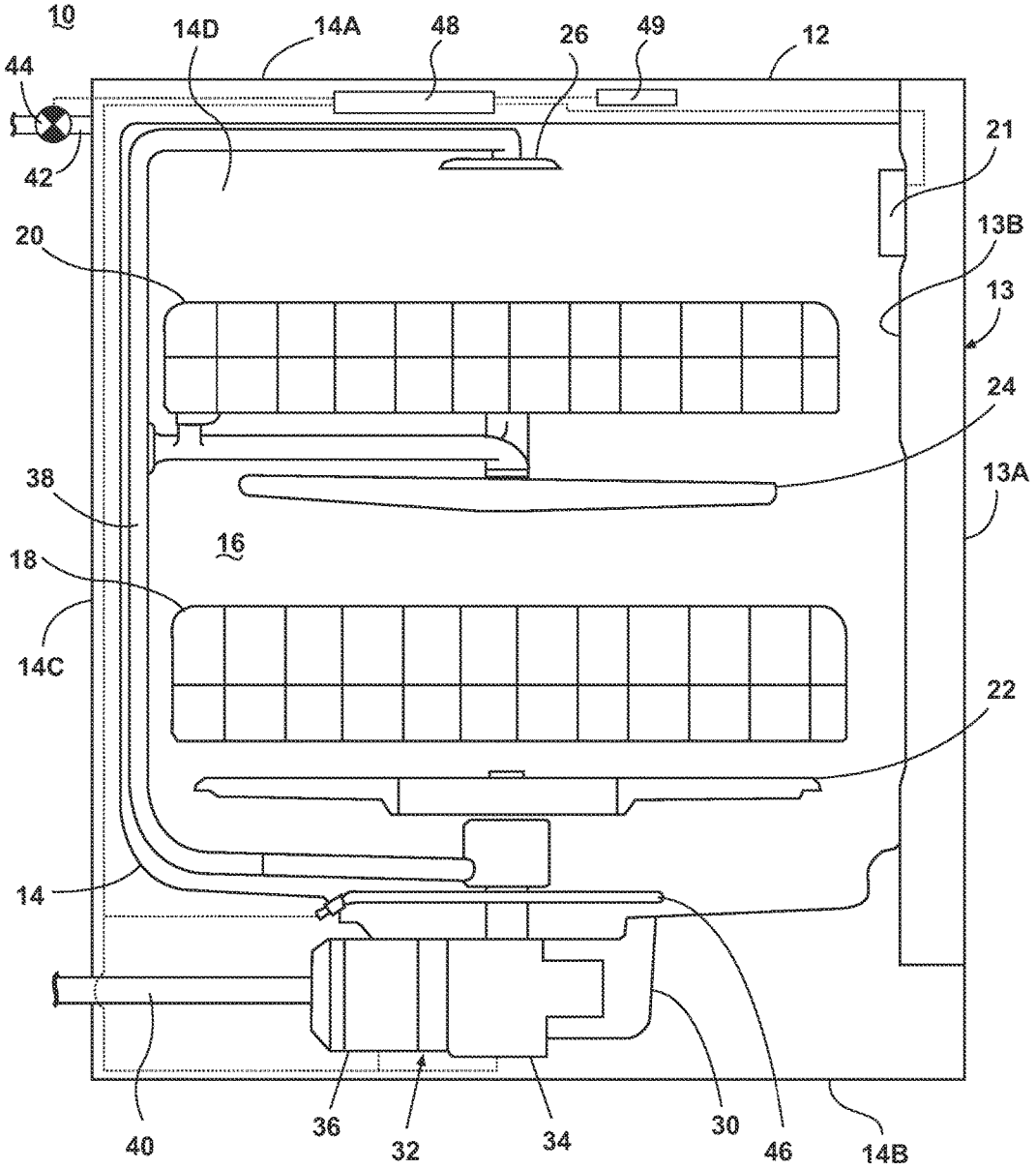
FIG. 1 is a schematic, side view of a dishwasher, with utensil racks having slidably adjustable tines and fixed tines according to a first embodiment of the invention.

FIG. 1 is a schematic, side view of a treating appliance according to a first embodiment of the invention, which is illustrated in the context of an automatic dishwasher 10. While the illustrated treating appliance may be a dishwasher 10, other treating appliances are possible, non-limiting examples of which include other types of dishwashing units, such as in-sink dishwashers, multi-tub dishwashers, drawer-type dishwashers. The dishwasher 10, which shares many features of a conventional automatic dishwasher, will not be described in detail herein except as necessary for a complete understanding of the invention.

The dishwasher 10 may have a cabinet 12 defining an interior, which is accessible through a door 13. The cabinet 12 may comprise a chassis or frame to which optional decorative panels may be mounted. For built-in dishwashers, the outer panels are typically not needed. At least one wash tub 14 is provided within the interior of the cabinet 12 and defines a treating chamber 16 to receive and treat utensils according to a cycle of operation, often referred to as a wash cycle whether or not washing occurs. The wash tub 14 has an open face that is closed by the door 13.

The door 13 and wash tub 14 may comprise large planar elements. For example, the door 13 may have a front panel 13A and rear panel 13B, which define a space therebetween. The wash tub 14 may be a stamped metal tub or an injection molded plastic tub, with top wall 14A, bottom wall 14B, rear wall 14C and opposing side walls 14D. The walls all define large planar elements. If there are decorative panels attached to the chassis or frame, they also would form large planar elements.

A treating chemistry dispenser 21 may be located in the door 13. It will be understood that depending on the type of dishwasher and the type of treating chemistry used, the treating chemistry dispenser 21 may be incorporated into one dispensing mechanism. The treating chemistry dispenser 21 may be of a single use dispenser type or a bulk dispenser type. In the case of bulk dispensing, the treating chemistry such as detergent and/or rinse aid can be selectively dispensed into the treating chamber 16 in a regulated quantity and at a predetermined time or multiple times during a cycle of operation.

One or more utensil racks, such as lower utensil rack 18 and an upper utensil rack 20 may be provided in the treating chamber 16. The racks 18, 20 may hold utensils (not shown) that may be treated in the treating chamber 16. The racks 18, 20 may be slid in and out of the treating chamber 16 through the opening closed by the door 13.

A spray system may be provided for supplying liquid to the treating chamber 16 as part of a wash cycle for washing any utensils within the racks 18, 20. The spray system may include one or more liquid sprayers, which are illustrated in the form of spray arm assemblies 22, 24, 26, that are provided within the treating chamber 16 and are oriented relative to the racks 18, such that liquid sprayed from the spray arm assemblies 22, 24, 26 may be directed into one or more of the racks 18, 20.

It should be noted that the stacked arrangement of the utensil racks 18, 20 and the spray arm assemblies 22, 24, 26 is not limiting to the invention. It merely serves to illustrate the invention. For example, the invention may be implemented in a stacked arrangement having a silverware basket, the lower and upper utensil rack, and with upper, middle, and lower level spray arm assemblies having spray heads for the silverware basket alternatively arranged in between the lower and upper utensil rack.

A recirculation system comprises a pump assembly 32 and recirculates sprayed liquid in the treating chamber 16 to the spray system. A sump 30 may be provided to collect, by gravity, the sprayed liquid. The sump 30 may be illustrated as being formed with or affixed to a lower portion of the wash tub 14 to collect liquid that may be supplied into or circulated in the wash tub 14 during, before, or after a cycle of operation. However, the sump 30 may be remote from the wash tub 14 and fluidly coupled by suitable fluid conduits.

The pump assembly 32 may be fluidly coupled to the sump 30, and as illustrated, may include a recirculation pump 34 and a drain pump 36. The recirculation pump 34 fluidly couples the sump 30 to the spray arm assemblies 22, 24, 26 through a spray arm supply conduit 38 to recirculate liquid that collects in the sump 30 to the spray arm assemblies 22, 24, 26 for spraying on the racks 18, 20. The drain pump 36 fluidly couples the sump 30 to a drain conduit 40 for draining liquid collected in the sump 30 to a household drain, such as a sewer line, or the like.

While the pump assembly 32 may include the recirculation pump 34 and the drain pump 36, in an alternative embodiment, the pump assembly 32 may include a single pump, which may be operated to supply liquid to either the drain conduit 40 or the spray arm support conduit 38, such as by rotating in opposite directions or by valves. Each of the recirculation pump 34 and drain pump 36 may be operably coupled to a separate motor (not shown) while one motor may be shared by a single pump assembly 32.

A liquid supply, which is illustrated as a water conduit 42, may be configured to couple to a household water supply line, and a valve 44, such as a solenoid valve, which couples the water conduit to the treating chamber 16. The ON/OFF actuation of the valve controls the supply of water into the treating chamber.

A heating system, which is illustrated as comprising an immersible, resistive heating element 46, is provided for heating liquid in the treating chamber 16.

A controller 48 is operably coupled to the dispenser 21, pumps 34, 36, valve 44, and heating element 46 to control their operation to implement a cycle of operation. The controller 48 may be a microprocessor controller having one or more cycles of operation stored in memory and selectable by the user via a user interface 49. The cycles of operation may comprise a plurality of instructions that are executable by the microprocessor.

Figure 2:
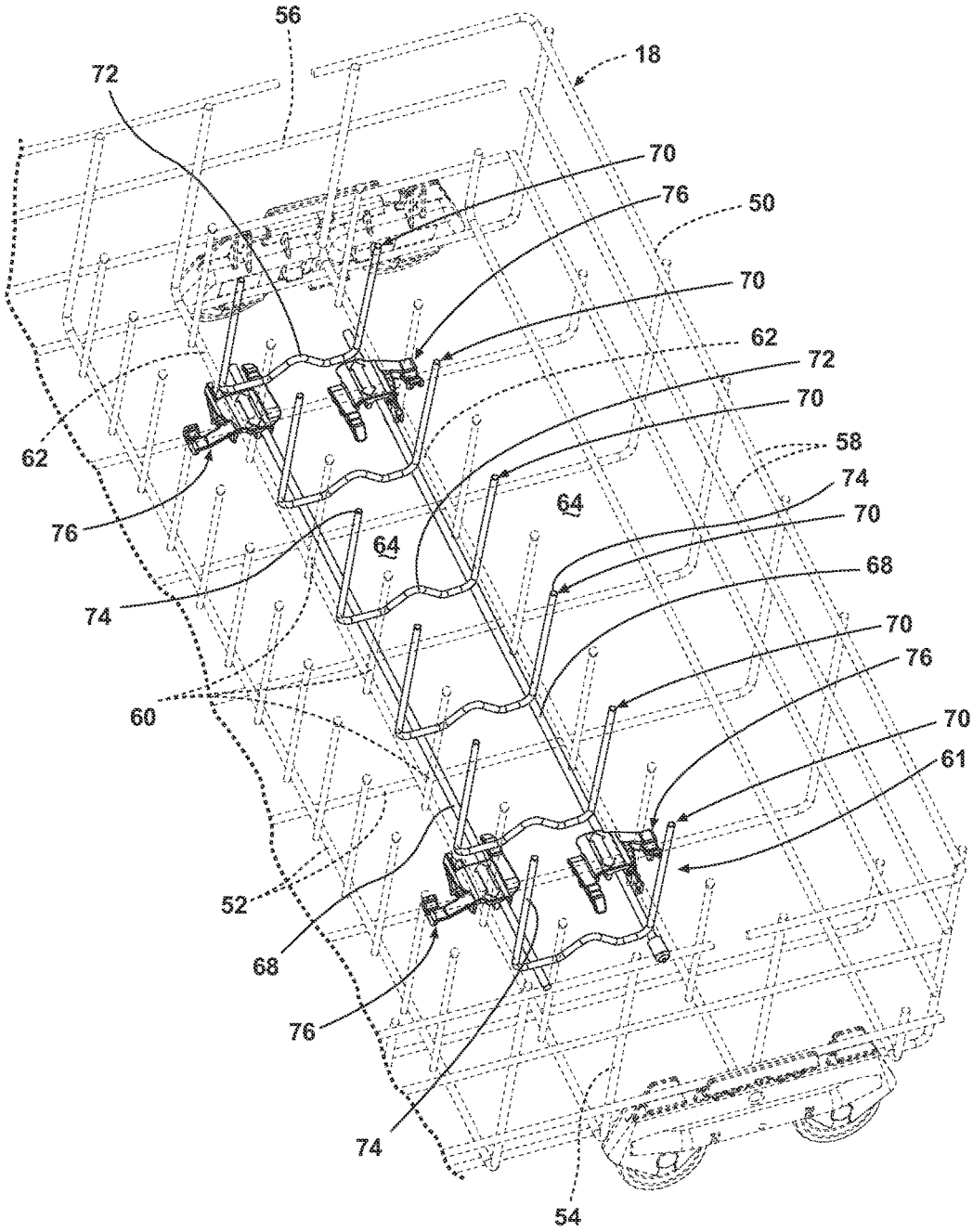
FIG. 2 is a partial perspective view of the rack of FIG. 1, with slidably adjustable tines and couplings shown in solid lines and the remainder shown in phantom lines for ease of viewing the slidably adjustable tines and couplings.

FIG. 2 is a partial perspective view of a portion of rack 18 having fixed tines 60 and slidably adjustable tines 61 in the form of a carriage according to an embodiment of the invention. As illustrated, the rack 18 may include a wire-frame body 50 having a bottom 52, front 54, back 56, and sides 58. The plurality of fixed tines 60 extend upwardly from the bottom 52 and span from the front 54 to back 56 of the rack 18. At least some of the fixed tines 60 may be arranged in rows 62 such that a passage 64 may be defined between the rows 62. The fixed tines 60 on opposing rows may be thought of as being arranged in pairs. While the fixed tines 60 may be at a right angle with respect to the bottom 52 of the rack 18, it is understood that the fixed tines 60 may be configured to slant relative to the bottom 52 of the rack 18 in another embodiment. It is also understood that the spacing of the fixed tines 60 in the rows with the carriage 61 may be greater than the normal spacing of the fixed tines 60 in the rows with no carriage 61.

The slidably adjustable tines 61 illustrated in the form of a carriage may include at least two laterally spaced carriage rails 68, which are spanned by one or more continuous wires 70, which may be spaced along the carriage rails 68. The continuous wire 70 may include at least one bight portion 72 spanning and connected to the at least two laterally spaced carriage rails 68, and one or more legs 74 extending upwardly on opposite side of the bight portion 72, with the legs 74 forming the slidably adjustable tines 61.

The spacing between adjacent wires 70 along a carriage rail 68 may be any desired amount and is advantageously substantially the same as the spacing between fixed tines 60 along a row 62. One or more couplings 76 may be provided to couple the carriage 61 to the rack 18 for relative slidable movement. The couplings 76 may be fixedly coupled to the rack 18 and slidably coupled to a carriage rail 68 to provide for the sliding of the carriage 61 to the rack 18 to effect the relative slidable movement.

Figure 3:
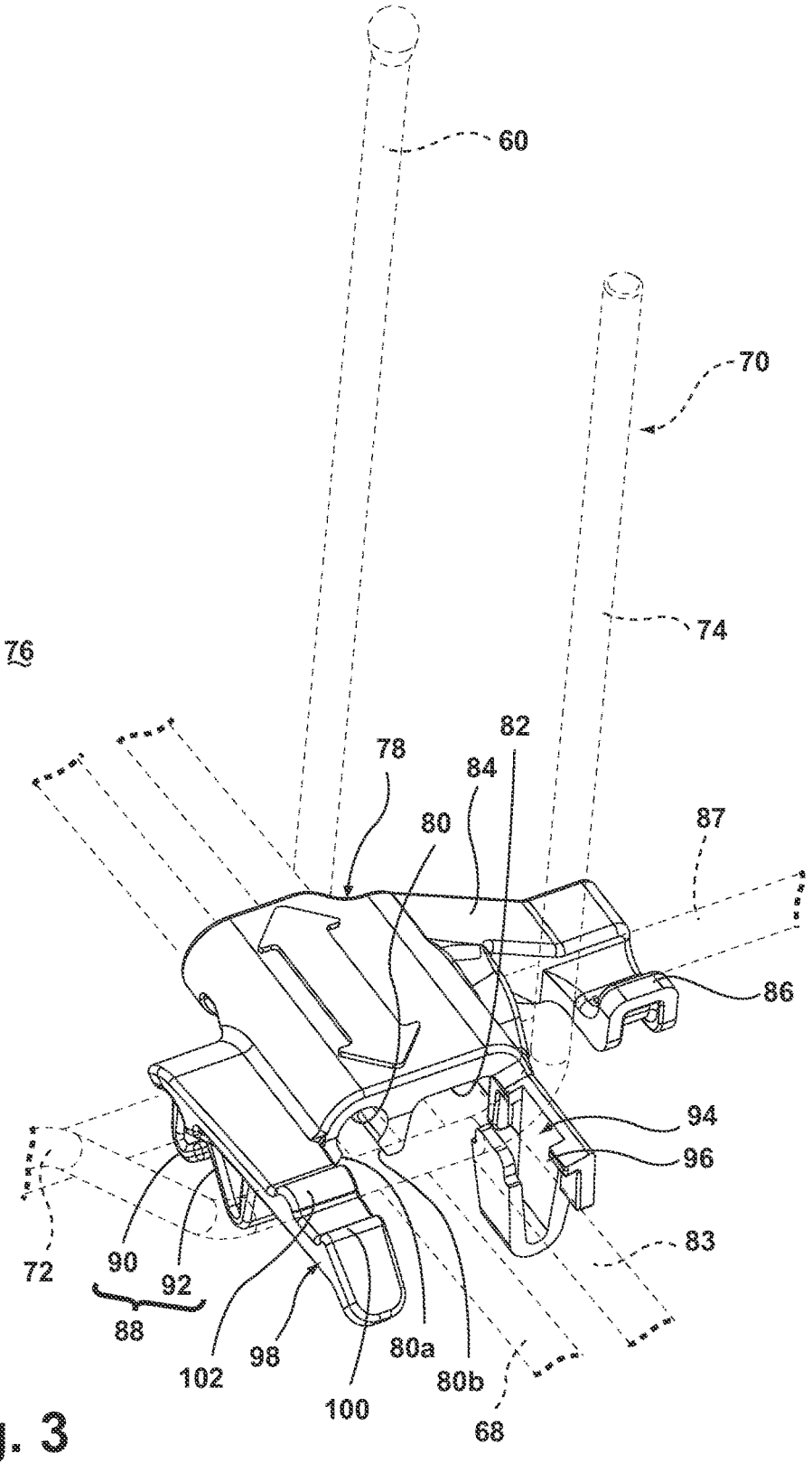
FIG. 3 is a perspective, close-up view of a coupling for the slidably adjustable tines of FIG. 2.

The details of the couplings 76 is best seen with respect to FIG. 3, where a coupling 76 is shown as having a body 78 with a first channel 80 in the form of a passage receiving a carriage rail 68 and a second channel 82 receiving a first rack wire 83 of the bottom 52 of the rack 18. The first channel 80 has a C-shaped cross-section, which defines opposing spring fingers 80*a*, 80*b* that encircle and "grip" the carriage rail 68 to apply a friction force to the carriage rail 68 that resists the sliding movement of the carriage rail 68. A finger 84, terminating in a hook 86, extends from one side of the body 78, and a spring clip 88, having confronting spring fingers 90, 92, extends from another side of the body 78. A force applicator 94, having a biasing element 96, illustrated as a spring finger, extends from the body 78 in a direction generally parallel to the second channel 82. A detent in the form of a locking tab 98 with a step 100 and a bump 102 extends from the body 78 above the spring clip 88 and in a direction generally parallel to the first channel 82.

To couple the rack 18 and carriage 61, the hook 86 is placed under a second rack wire 87 to form a pivot point about which the body 78 is rotated until the first and second channels 80, 82 overlie the carriage rail 68 and the first rack wire 83 and the confronting spring fingers 90, 92 of the spring clip 88 overlie the second rack wire 87, where the continued rotation or a pressing down of the body 78 forces apart the spring fingers 80*a*, 80*b* to receive the carriage rail 68 and forces the second rack wire 87 through the confronting spring fingers 90, 92 to mount the coupling 76 to the rack 18.

When the coupling 76 is mounted to the rack 18 as described, the biasing element 96 of the force applicator 94 applies a force against the first rack wire 83 having a predetermined range of diameters, to help resiliently hold the coupling 76 in place, and the spring fingers 80*a*, 80*b* grip the carriage rail 68 to apply a transverse force to the carriage rail 68, which resists slidable movement of the carriage 61 relative to the rack 18. The transverse force can be of any amount. Advantageously, it is of an amount sufficient to prevent the sliding movement of the carriage 61 under normal and/or expected operating conditions, yet is small enough that a human user can easily slide the carriage 61 when desired.

The sliding movement of the carriage 61 relative to the rack 18 may be further limited by the locking tab 98. When the sliding of the carriage 61 results in the step 100 contacting the bight portion 72 of a wire 70, the continued sliding results in a deflection of the locking tab 98 until the bight portion passes over the step 100 and the locking tab 98 returns to its non-deflected position. Further sliding of the wire 70 beyond the step 100 allows the bight portion 72 pass over the bump 102 for final engagement. Reverse sliding of the carriage 61 is then resisted when the bight portion 72 contacts the step 100. The user may press down on the locking tab 98 or apply a greater sliding force to the carriage 61 to move the carriage 61 beyond the step 100.

Figure 4:
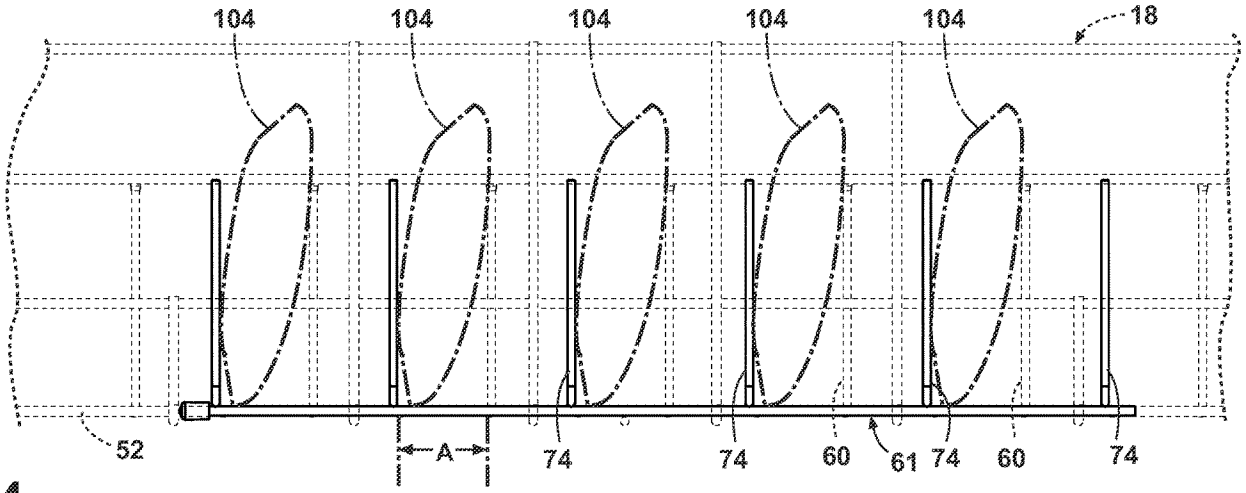
FIG. 4 is a side view of the rack with the slidably adjustable tines positioned between adjacent fixed tines of the rack.
Figure 5:
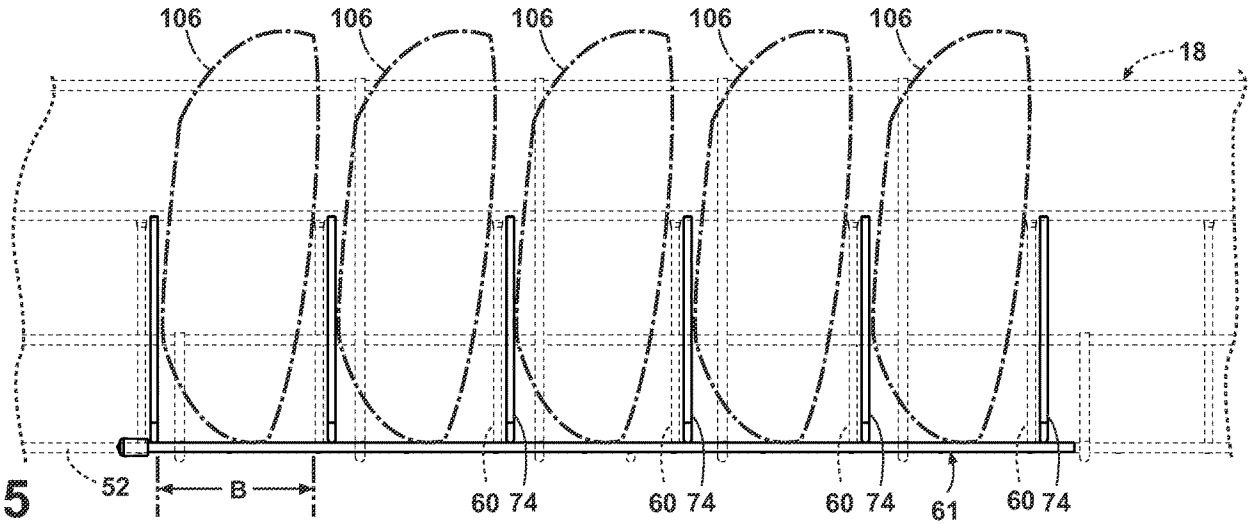
FIG. 5 is a side view of the rack with the slidably adjustable tines substantially overlapping the fixed tines.

Referring to FIGS. 4 and 5, the relative positions of the slidably adjustable tines 61 with respect to the fixed tines 60 with the sliding operation of carriage 61 are illustrated. When the rack 18 receives the utensils to be treated, the relative position of the slidable carriage 61 with respect to the rack 18 may be determined and adjusted based on the overall shape and dimension of the utensils to be received in the rack 18. For example, in case the undersized utensil such as shallow dishes 104 (in phantom) are received by the rack 18, the carriage 61 may be slid in the passage in a sliding direction such that the carriage tines 74 may be positioned between adjacent fixed tines 60 of the rack 18 (FIG. 4). As illustrated, the shallow dishes 104 may be provided with additional support from the carriage tines 74, and may be positioned substantially upright with a uniform gap between adjacent dishes 104. Under this condition, the shallow dishes 104 may receive a uniform supply of liquid during a wash cycle supplied from the spray arm assemblies through the uniform gaps between utensils, and enhanced chemical action may be expected.

It is contemplated that if the utensils are not received in a substantially upright position with an appropriate gap between adjacent utensils, the surface of the utensil may be masked by adjacent utensils or any component of the dishwasher 10, and may be prevented from being provided with liquid during a wash cycle. As a result, poor treatment performance may be expected.

In case shallower and/or smaller utensils are to be treated in the rack 18, further adjustment of the position of the carriage 61 in the sliding direction relative to the fixed rack 18 may be warranted such that the smaller spacing (A) between the carriage tines 74 and fixed tines 60 may be achieved, and the utensils may be stably supported by the carriage tines 74 and fixed tines 60.

In contrast, if an oversized utensil 106 (in phantom) such as a pie dish or deep bowl are to be treated in the rack 18, the carriage 61 may be adjusted such that the position of the carriage tines 74 be in a close proximity to or substantially overlap with the fixed rack tines 60 (FIG. 5). Under this condition, the spacing (B) between adjacent tines illustrated in FIG. 5 may be substantially double the spacing (A) between adjacent tines shown in FIG. 4. As a result, oversized utensils 106 may be fully received between adjacent tines, without covering multiple tines in an unstable way or lying on the bottom 52 of the rack 18.

The oversized utensils 106, as with the shallow dishes 104, are still received in a substantially upright position with an appropriate gap between adjacent utensils to permit the inflow of liquid. Absent the ability to adjust the spacing, the oversized utensils would have physically masked one another from the liquid spray. To avoid this, the oversized utensils would have to be laid face down on the rack 18, which would have greatly reduced the number of oversized utensils that could be accommodated in the rack 18.

Figure 6:
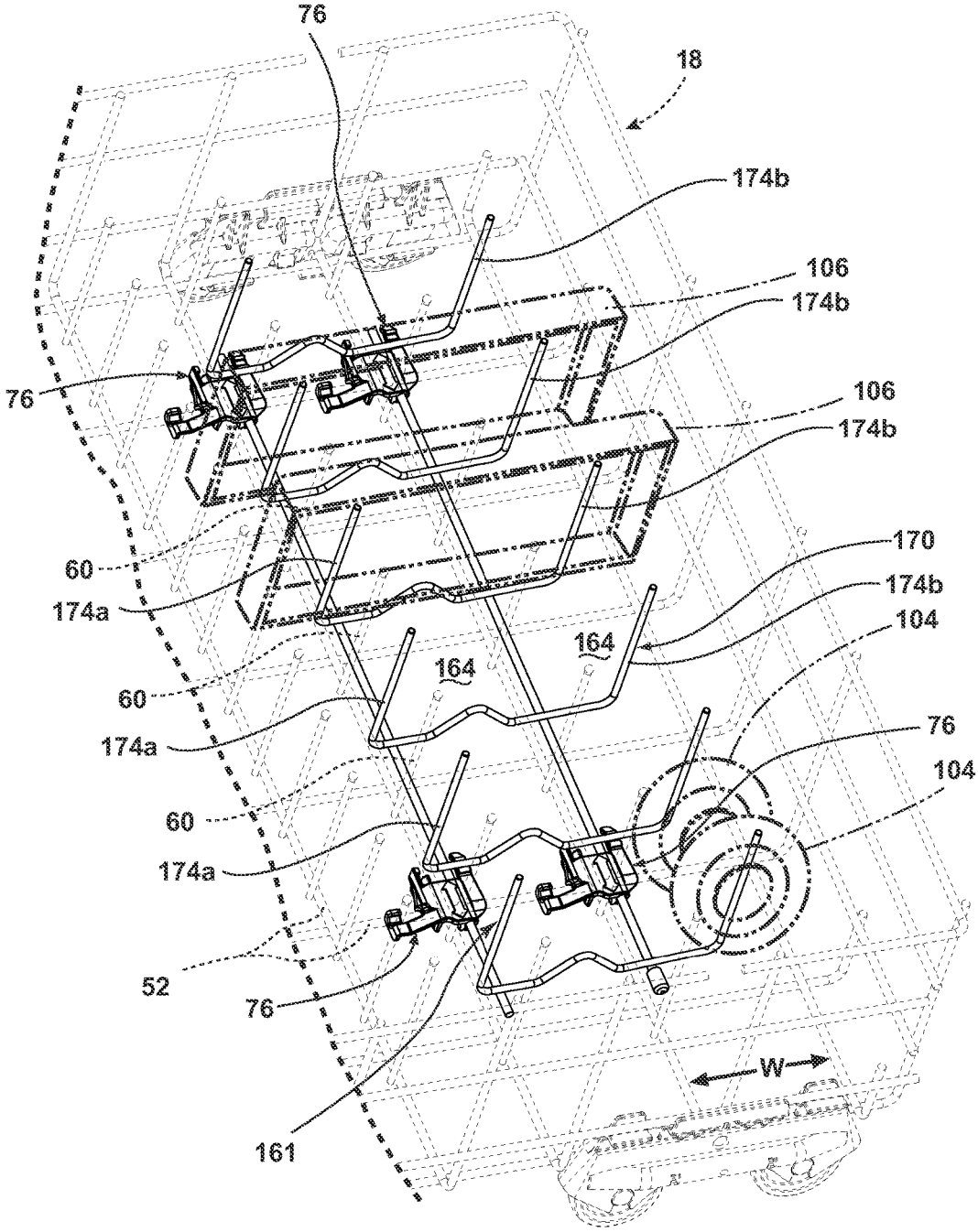
FIG. 6 is a perspective view of a first slidably adjustable tine of a pair being aligned with a first row of fixed tines and a second slidably adjustable tine of the pair being offset from a second row of rack tines, according to a second embodiment of the invention.

FIG. 6 illustrates the rack 18 mounted with the slidable carriage 161 according to a second embodiment of the invention, which is substantially identical to the first embodiment, except that the wires 170 of the second embodiment contain second leg **174*b* that is laterally offset compared to the first leg 174*a*, which is still substantially aligned with the rows of fixed tines 60. The lateral offset may be any amount. Advantageously, the lateral offset is such that the second leg 174*b* extends laterally into the interior of the adjacent passage 164**.

The offset feature may benefit oversized utensils that tend to be oversized in all dimensions. Thus, when the depth of the oversized utensil is sufficient to warrant an adjustment to the spacing for proper cleaning, the oversized utensils may extend laterally a sufficient amount that the normal row spacing of the tines is not great enough to support the lateral dimension of the oversized utensil and the oversized utensil will fall over, resulting in the need to lay the oversized utensil face down. The greater lateral spacing between the tines **174*a*, 174*b*** provides proper lateral support for the oversized utensil and serves to retain the oversized utensil in a substantially vertically orientation.

It may be further noted that the offset feature may benefit not only oversized utensils 106, but also undersized utensils 104. For example, the undersized utensils 104 whose maximum lateral dimensions are smaller than the width (W) of the passage 164 may be supported by the second leg **174*b* of the carriage 161**.

Figure 7:
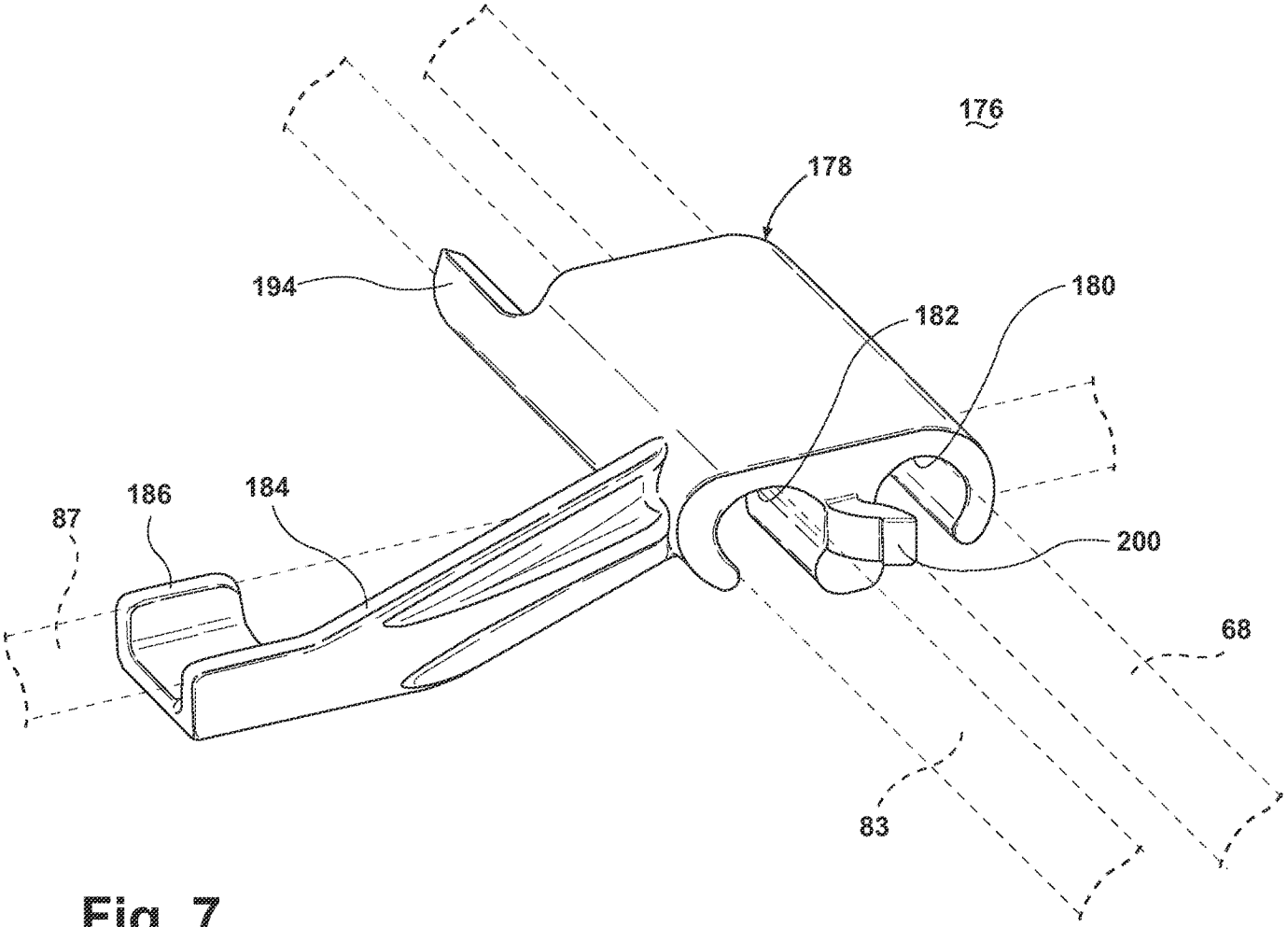
FIG. 7 is a perspective, close-up view of an alternative coupling, according to a third embodiment of the invention.

FIG. 7 is a perspective, close-up view of an alternative coupling 176 having a body 178 according to a third embodiment of the invention. The body 178 may include a first channel 180 and a second channel 182 receiving the carriage rail 68 and first rack wire 83, respectively. A finger 184, terminating in a hook 186, extends from one side of the body 178, and a recess may be formed in another side of the body 178 to receive the second rack wire 87. A force applicator 194 extends from the body 178 in a direction generally parallel to the second channel 182. The shape and dimension of force applicator 194 may be configured to make the second channel 182 tightly receive the first rack wire 83 and provide a biasing function. A biasing finger 200 extends from the body 178 and presses against the carriage rail 68.

To couple the rack 18 and carriage 61, the hook 186 is placed under the second rack wire 87 to form a pivot point about which the body 178 is rotated until the first and second channels 180, 182 overlie the carriage rail 68 and the first rack wire 83, and the recess overlies the second rack wire 87, where the continued rotation or a pressing down of the body 178 forces the second rack wire 87 into the recess to mount the coupling 176 to the rack 18

When the coupling 176 is mounted to the rack 18 as described, the force applicator 194 applies a transverse force against the first rack wire 83 to help secure the body 178 in position, and the biasing finger 200 applies a transverse force to the carriage rail 68, which resists slidable movement of the carriage 61 relative to the rack 18.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for cleaning utensils according to at least one automatic cycle of operation, comprising:

a tub at least partially defining a treating chamber for receiving utensils for cleaning;

a spray system for spraying liquid in the treating chamber;

a rack located within the treating chamber and having two laterally-spaced upwardly-extending rows of rack tines defining a passage in between;

a carriage located within the passage, wherein the carriage comprises two laterally spaced carriage rails;

two laterally-spaced upwardly-extending rows of carriage tines extending upwardly from the carriage rails parallel to the rows of rack tines;

a coupler slidably mounting the carriage to the rack within the passage for slidable movement of the carriage within the passage relative to the rows of rack tines along a sliding range of motion, and applying a sliding resistance force to the carriage to hold the carriage in a sliding position along the sliding range of motion;

a first continuous wire having a bight portion spanning and connected to the two carriage rails and legs extending upwardly on opposite sides of the bight portion forming a pair of the carriage tines; and a second continuous wire having a bight portion spanning and connected to the two carriage rails and separated from the first continuous wire and legs extending upwardly on opposite sides of the bight portion of the second continuous wire forming a second pair of the carriage tines;

wherein the coupler slidably receives one of the carriage rails between the first and second continuous wires, and the coupler contacts the first and second continuous wires as the carriage is slid through the sliding range of motion to limit the sliding range of motion to a sliding distance between the first and second continuous wires.

2. The dishwasher of claim 1 wherein first and second rack tines are spaced along the passage by a first distance substantially the same as a second distance between the first and second continuous wires.

3. A dishwasher for cleaning utensils according to at least one automatic cycle of operation, comprising:

a tub at least partially defining a treating chamber for receiving utensils for cleaning;

a spray system for spraying liquid in the treating chamber;

a rack located within the treating chamber and having two laterally-spaced upwardly-extending rows of rack tines defining a passage in between;

a carriage located within the passage, wherein the carriage comprises two laterally-spaced carriage rails;

two laterally-spaced upwardly-extending rows of carriage tines extending upwardly from the carriage rails parallel to the rows of rack tines;

a coupler slidably mounting the carriage to the rack within the passage for slidable movement of the carriage within the passage relative to the rows of rack tines along a sliding range of motion, and applying a sliding resistance force to the carriage to hold the carriage in a sliding position along the sliding range of motion; and a first continuous wire having a bight portion spanning and connected to the two carriage rails and legs extending upwardly on opposite sides of the bight portion forming a pair of the carriage tines;

wherein the coupler comprises a spring clip snapped onto the bight portion.

4. The dishwasher of claim 3 wherein one of a first of the carriage tines and the coupler comprises a detent to fix the location of the carriage tines relative to the rack tines.

5. The dishwasher of claim 3 wherein the coupler comprises a passage slidably receiving one of the carriage rails.

6. The dishwasher of claim 5 wherein the rack comprises a rack rail from which one of the two rows of rack tines extend, and the coupler comprises a hook coupling to the rack rail.

7. The dishwasher of claim 3 wherein the bight portion has an upwardly extending portion.

8. A dishwasher for cleaning utensils according to at least one automatic cycle of operation, comprising:

a tub at least partially defining a treating chamber for receiving utensils for cleaning;

a spray system for spraying liquid in the treating chamber;

a rack located within the treating chamber and having two laterally-spaced upwardly-extending rows of rack tines defining a passage in between and two laterally-spaced rack rails from which respective ones of the two rows of rack tines extend upwardly;

a carriage located within the passage and comprising two laterally-spaced carriage rails;

two laterally-spaced upwardly-extending rows of carriage tines extending upwardly from the carriage rails parallel to the rows of rack tines;

a coupler slidably mounting the carriage to the rack within the passage for slidable movement of the carriage within the passage relative to the rows of rack tines along a sliding range of motion, and applying a sliding resistance force to the carriage to hold the carriage in a sliding position along the sliding range of motion;

wherein the coupler fixedly mounts to one of the rack rails and slidably mounts to one of the carriage rails to slidably mount the carriage to the rack;

wherein the coupler comprises a force applicator applying the sliding resistance force to the one of the carriage rails and the force applicator is a spring finger abutting the one of the carriage rails to apply a contact force on the one of the carriage rails lateral to the sliding range of motion to form the sliding resistance force; and wherein the coupler comprises a spring clip snapped onto the carriage.

9. The dishwasher of claim 8 wherein the coupler comprises a passage slidably receiving the one of carriage rails.

10. The dishwasher of claim 9 wherein the coupler comprises a hook coupling to the rack.

11. The dishwasher of claim 8 wherein the two rows of carriage tines have a same or greater spacing than the two rows of rack tines.

* * * * *